US006048674A

United States Patent [19]

McInerney et al.

[11] Patent Number: 6,048,674

[45] Date of Patent: Apr. 11, 2000

[54] COUPLER SET FOR SILVER HALIDE COLOR IMAGING

[75] Inventors: Elizabeth McInerney; Patti L. Bushnell, both of Rochester, N.Y.

[73] Assignee: Eastman Kodak Company, Rochester, N.Y.

[21] Appl. No.: 09/221,662

[22] Filed: Dec. 23, 1998

Related U.S. Application Data

[63] Continuation-in-part of application No. 08/700,254, Aug. 20, 1996, abandoned.

[51] Int. Cl.[7] ..... G03C 7/46

[52] U.S. Cl. ..... 430/383; 430/384; 430/385; 430/434; 430/435; 430/441; 430/442; 430/502; 430/503; 430/504; 430/543

[58] Field of Search ..... 430/383, 384, 430/385, 434, 435, 441, 442, 502, 503, 504, 543, 552, 553, 556, 557, 558

[56] References Cited

U.S. PATENT DOCUMENTS

| | | | |
|---|---|---|---|
| 4,311,775 | 1/1982 | Regan | 430/37 |
| 5,378,590 | 1/1995 | Ford et al. | 430/504 |
| 5,378,596 | 1/1995 | Naruse et al. | 430/552 |
| 5,514,527 | 5/1996 | Abe et al. | 430/503 |

OTHER PUBLICATIONS

The Reproduction of Color, Hunt 5th Ed. pp. 177–192.

The Color Gamut Obtainable by the Combination of Subtractive Color Dyes. Optimum Absorption Bands as Defined by Nonlinear Optimization Technique, J. Imaging Science, 30, 9–12; by N. Ohta.

Brightness and Hue of Present Day Dyes in Relation to Colour Photography, by ME Clarkson and T. Vickerstaff, Photo J. 88b, 26 (1948).

*Primary Examiner*—Geraldine Letscher

*Attorney, Agent, or Firm*—Arthur E. Kluegel

[57] ABSTRACT

The invention provides photographic element comprising a first light sensitive silver halide emulsion layer having associated therewith a cyan dye-forming coupler, a second light sensitive silver halide emulsion layer having associated therewith a magenta dye-forming coupler, and a third light sensitive silver halide emulsion layer having associated therewith a yellow dye-forming coupler, wherein the normalized spectral transmission density distribution curve of the dye formed by the cyan coupler upon development with a p-phenylenediamine developer has a density between 0.7 and 0.78 at 600 nm and a density between 0.8 and 0.91 at 610 nm. Such an element enables an increase in the color gamut for imaging.

19 Claims, No Drawings

COUPLER SET FOR SILVER HALIDE COLOR IMAGING

CROSS REFERENCE TO RELATED APPLICATION

This application is a Continuation-In-Part of Continued Prosecution Application under 1.53 (d) U.S. Ser. No. 08/700, 254 filed Aug. 20, 1996, now abandoned.

FIELD OF THE INVENTION

This invention relates to a coupler set for silver halide imaging systems. More specifically, it relates to such a coupler set comprising cyan, magenta, and yellow couplers wherein the dye formed by the cyan coupler has a particular transmittance spectra which increases the gamut of colors possible from the coupler set.

BACKGROUND OF THE INVENTION

Color gamut is an important feature of color printing and imaging systems. It is a measure of the range of colors that can be produced using a given combination of colorants. It is desirable for the color gamut to be as large as possible. The color gamut of the imaging system is controlled primarily by the absorption characteristics of the set of colorants used to produce the image. Imaging systems typically employ three or more colorants, typically including cyan, magenta, and yellow in the conventional subtractive imaging system. It is also common for such systems to include an achromic colorant such as black.

The ability to produce an image containing any particular color is limited by the color gamut of the system and materials used to produce the image. Thus, the range of colors available for image reproduction is limited by the color gamut that the system and materials can produce.

Color gamut is often thought to be maximized by the use of so-called "block dyes". In *The Reproduction of Colour* 4th ed., R. W. G. Hunt, Pp 135–144, it has been suggested that the optimum gamut could be obtained with a subtractive three-color system using three theoretical block dyes where the blocks are separated at approximately 490 nm and 580 nm. This proposal is interesting but cannot be implemented for various reasons. In particular, there are no real colorants corresponding to the proposed block dyes.

Variations in the block dye concept are advanced by Clarkson, M., E., and Vickerstaff, T., in "Brightness and Hue of Present-Day Dyes in Relation to Colour Photography," Photo. J. 88b, 26 (1948). Three example shapes are given by Clarkson and Vickerstaff: Block, Trapezoidal, and Triangular. The authors conclude, contrary to the teachings of Hunt, that a trapezoidal absorption spectra may be preferred to a vertical sided block dye. Again, dyes having these trapezoidal spectra shapes are theoretical and are not available in practice.

Finally, both commercially available dyes and theoretical dyes were investigated in "The Color Gamut Obtainable by the Combination of Subtractive Color Dyes. Optimum Absorption Bands as Defined by Nonlinear Optimization Technique," J. Imaging Science, 30, 9–12. The author, N. Ohta, deals with the subject of real colorants and notes that the existing curve for a typical cyan dye, as shown in the publication, is the optimum absorption curve for cyan dyes from a gamut standpoint.

In spite of the foregoing teachings relative to color gamut, the coupler sets which have been employed in silver halide color imaging have not provided the range of gamut desired for modern imaging. It is therefore a problem to be solved to provide a coupler set which provides an increase in color gamut compared to the coupler sets heretofore used for silver halide imaging.

SUMMARY OF THE INVENTION

The invention provides a photographic element comprising a first light sensitive silver halide emulsion layer having associated therewith a cyan dye-forming coupler, a second light sensitive silver halide emulsion layer having associated therewith a magenta dye-forming coupler, and a third light sensitive silver halide emulsion layer having associated therewith a yellow dye-forming coupler, wherein the normalized spectral transmission density distribution curve of the dye formed by the cyan coupler upon development with a p-phenylenediamine developer has a density between 0.7 and 0.78 at 600 nm and a density between 0.8 and 0.91 at 610 nm. Such an element provides an increase in the color gamut available for imaging. The invention further includes an imaging method.

The coupler set of the invention provides increased color gamut compared to the coupler sets heretofore available.

DETAILED DESCRIPTION OF THE INVENTION

The invention is summarized in the preceding section. The coupler set of the invention employs subtractive color imaging. In such imaging, a color image is formed by generating a combination of cyan, magenta and yellow colorants in proportion to the amounts of exposure of red, green, and blue light respectively. The object is to provide a reproduction that is pleasing to the observer. Color in the reproduced image is composed of one or a combination of the cyan, magenta and yellow image colorants. The relationship of the original color to the reproduced color is a combination of many factors. It is, however, limited by the color gamut achievable by the multitude of combinations of cyan, magenta and yellow colorants used to generate the final image.

In addition to the individual colorant characteristics, it is necessary to have cyan, magenta and yellow colorants that have preferred absorption maxima relative to one another and that have absorption band shapes which function together to provide an optimum overall color gamut.

The CIELAB metrics, a*, b*, and L*, when specified in combination, describe the color of an object, whether it be red, green, blue (under fixed viewing conditions, etc. The measurement of a*, b*, and L* are well documented and now represent an international standard of color measurement. (The well known CIE system of color measurement was established by the International Commission on Illumination in 1931 and was further revised in 1971. For a more complete description of color measurement refer to "Principles of Color Technology, 2nd Edition by F. Billmeyer, Jr. and M. Saltzman, published by J. Wiley and Sons, 1981.)

Simply stated, a* is a measure of how green or magenta the color is (since they are color opposites) and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

where X, Y and Z are the tristimulus values obtained from the combination of the visible reflectance spectrum of the object, the illuminant source (i.e. 5000° K) and the standard observer function.

Simply stated, L* is a measure of how light or dark a color is. L*=100 is white. L*=0 is black. The value of L* is a function of the tristimulus value Y, thus $$L^*=116(Y/Y_n)^{1/3}-16$$

As used herein, the color gamut of a colorant set is the sum total of the nine slices of color space represented as the sum of a*×b* areas of 9L* slices (L*=10, 20, 30, 40, 50, 60, 70, 80, and 90) for the colorant or colorant set being tested. Color gamut may be obtained through measurement and estimation from a large sample of color patches (very tedious and time-consuming) or, as herein, calculated from the measured absorption characteristics of the individual colorants using the techniques described in J. Photographic Science, 38,163(1990).

The absorption characteristics of a given colorant will vary to some extent with a change in colorant amount (transferred density). This is due to factors such as a measurement flare, colorant-colorant interactions, colorant-receiver interactions, colorant concentration effects, and the presence of color impurities in the media. However, by using characteristic vector analysis (sometimes refereed to as principal component analysis or eigenvector analysis), one can determine a characteristic absorption curve that is representative of the absorption characteristics of the colorant over the complete wavelength and density ranges of interest. The characteristic vector for each colorant is thus a two-dimensional array of optical transmission density and wavelength. This technique is described by Albert J. Sant in Photographic Science and Engineering, 5(3), May-June 1961 and by J. L. Simonds in the Journal of the Optical Society of America, 53(8),968–974 (1963).

The characteristic vector for each colorant is a two-dimensional array of optical transmission density and wavelength normalized to a peak height of 1.0. The characteristic vector is obtained by first measuring the reflection spectra of test images comprising patches of varying densities or percentage coverage of the colorant, including 100% coverage (Dmax) and 0% coverage (Dmin). The spectral reflection density of the Dmin is then subtracted from the spectral reflection density of each color patch. The resulting Dmin subtracted reflection densities are then converted to transmission density by passing the density data through the DR/DT curve. Characteristic vector analysis is then used to find one transmission density curve for each colorant which, when scaled in transmission density space, converted to reflection density, and added to Dmin, gives a best fit to the measured spectral reflectance data. This characteristic vector is used herein to both specify the spectral absorption characteristics of the colorant and to calculate the color gamut of each imaging system employing the colorant.

The spectra herein are considered to be yellow if they have a maximum absorbance between 400 and 500 nm, magenta if they have a maximum between 500 and 600 nm, and cyan if they have a maximum between 600 and 700 nm. The curve shape is a function of many factors and is not merely a result of the selection of a particular colorant compound. Further the spectral curve may represent the composite absorbance of two or more compounds. For example, if one particular compound provides the desired spectral curve, the addition of further compounds of the same color may provide a composite curve which remains within the desired range. Thus, when two or more dyes of a particular color are employed, the spectral curve for the "magenta", "yellow"or "cyan" colorant, for purposes of this invention, means the composite curve obtained from these two or more colorants.

Besides the chemical constitution of the dyes, the spectral curve of a given dye can be affected by other system components (solvents, surfactants, etc.). These parameters are selected to provide the desired spectral curve.

As noted in the Summary of the Invention, the cyan coupler forms a dye that has a density between 0.7 and 0.78 at 600 nm and a density between 0.8 and 0.91 at 610 nm. The dye is formed upon reaction with a suitable developing agent such as a p-phenylenediamine color developing agent. Suitably the agent is CD-3 as disclosed for use in the RA-4 process of Eastman Kodak Company as described in the British Journal of Photography Annual of 1988, Pp 198–199. In a preferred embodiment, the density of the cyan dye is also between 0.5 and 1.0 at 590 nm and more preferably between 0.3 and 1.0 at 580 nm.

An example of a cyan dye forming coupler of the invention is one having Formula (I):

(I)

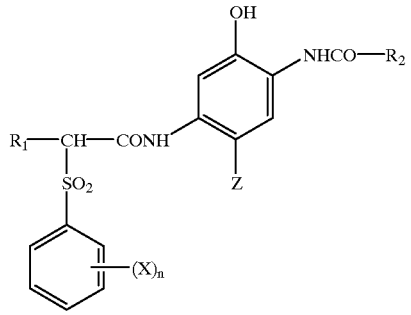

wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

Coupler (I) is a 2,5-diacylaminophenol cyan coupler in which the 5-acylamino moiety is an amide of a carboxylic acid which is substituted in the alpha position by a particular sulfone (—$SO_2$—) group. The sulfone moiety must be an arylsulfone and cannot be an alkylsulfone, and must be substituted only at the meta or para position of the aryl ring. In addition, the 2-acylamino moiety must be an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima (λmax) generally in the range of 620–645 nanometers, which is ideally suited for producing excellent color reproduction and high color saturation in color photographic papers.

Referring to formula (I), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl and dodecyl,; a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonamido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

In formula (I), each X is located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or, phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl group of 12 to 18 carbon atoms such as dodecyl, pentadecyl or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group". The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

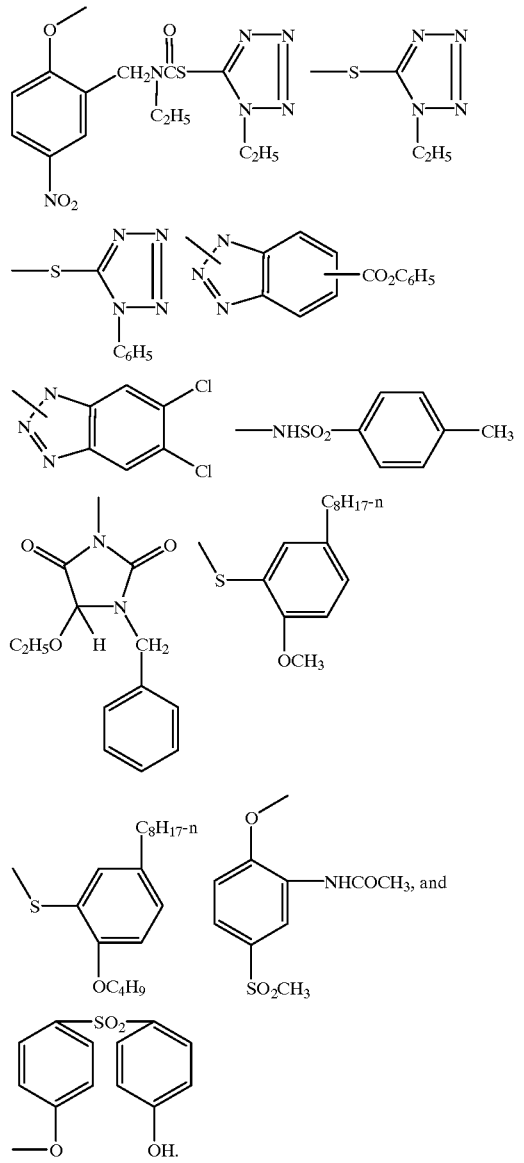

Typically, the coupling-off group is a chlorine atom.

It is essential that the substituent groups $R_1$, $R_2$, X, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, X, and Z. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of substituent groups $R_1$, $R_2$, X, and Z in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group. Therefore, in these embodiments the ballast would be primarily located as part of groups $R_2$, X, and Z. Furthermore, even if the coupling-off group Z contains a ballast it is often necessary to ballast the other substituents as well, since Z is eliminated from the molecule upon coupling; thus, the ballast is most advantageously provided as part of groups $R_2$ and X.

The following examples further illustrate the invention. It is not to be construed that the present invention is limited to these examples.

IC-1

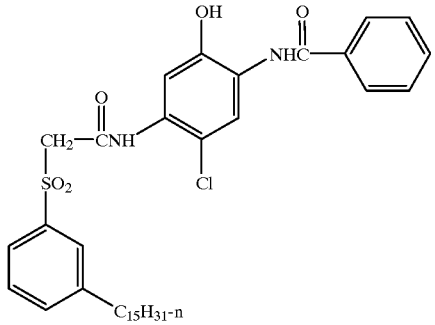

IC-2

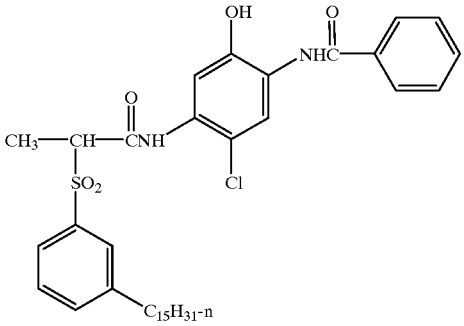

IC-3

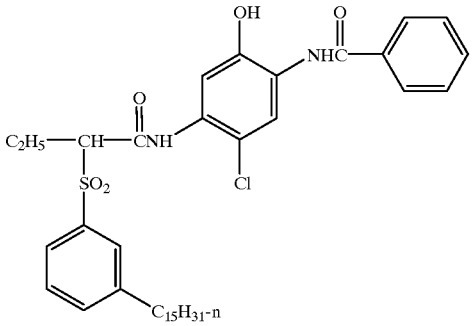

-continued

IC-4

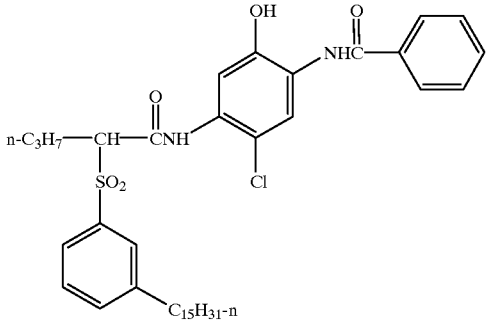

IC-5

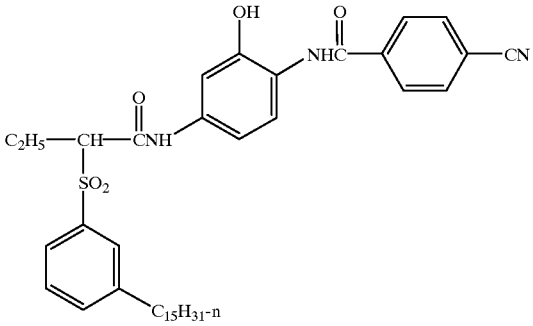

IC-6

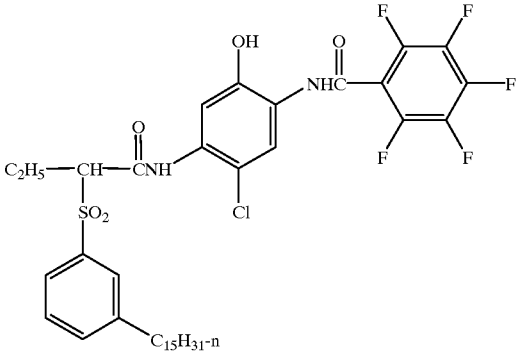

IC-7

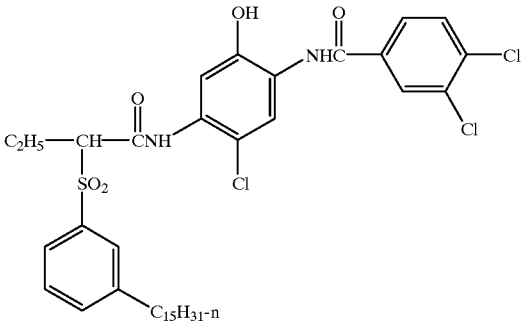

-continued
IC-8
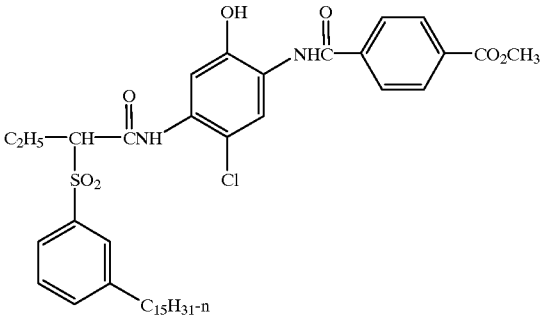
IC-9
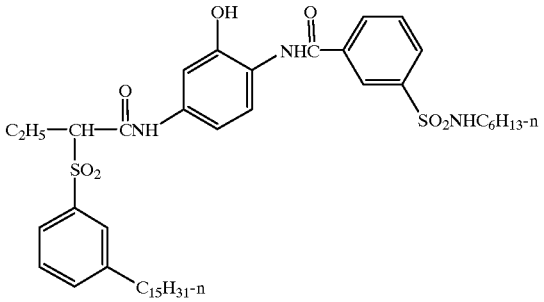
IC-10
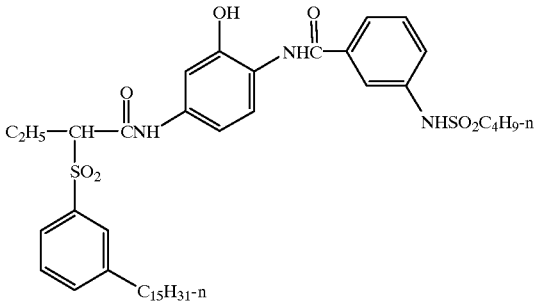
IC-11
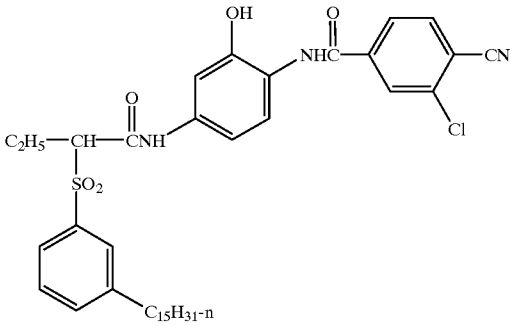
IC-12
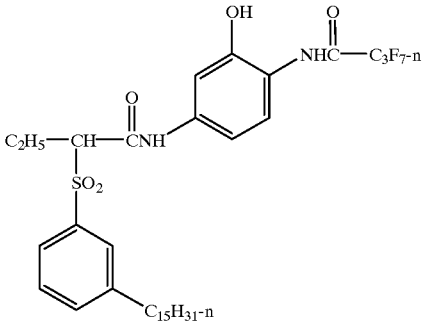
-continued
IC-13
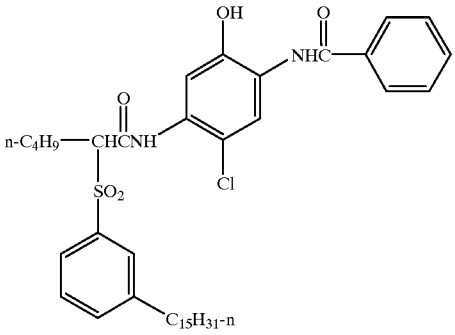
IC-14
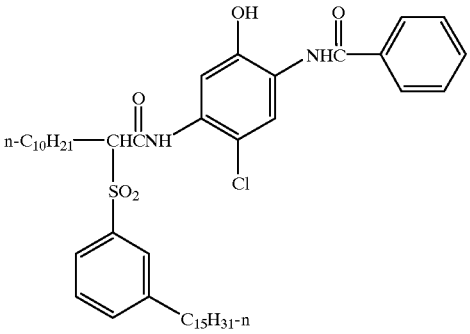
IC-15
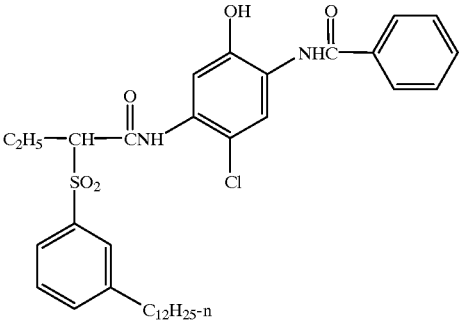
IC-16
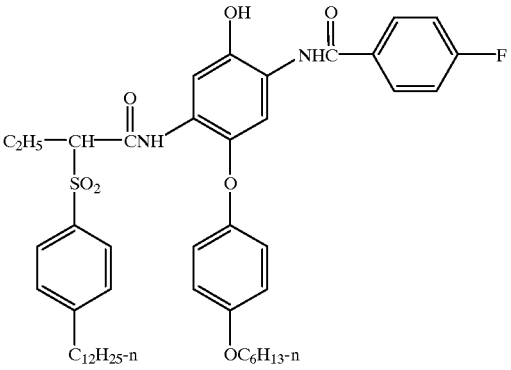

-continued
IC-17
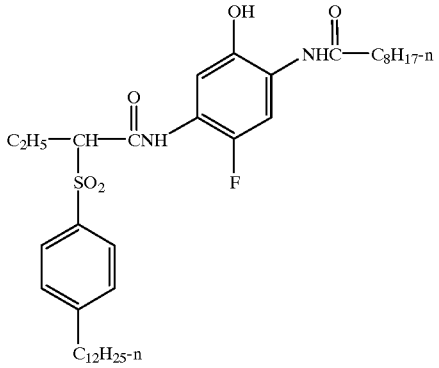
IC-18
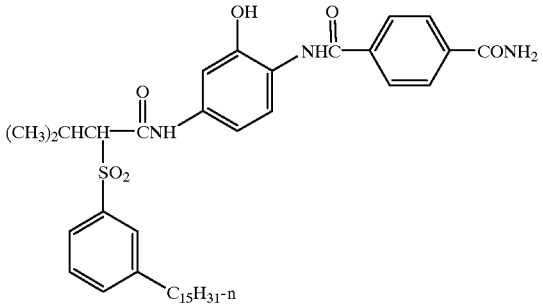
IC-19
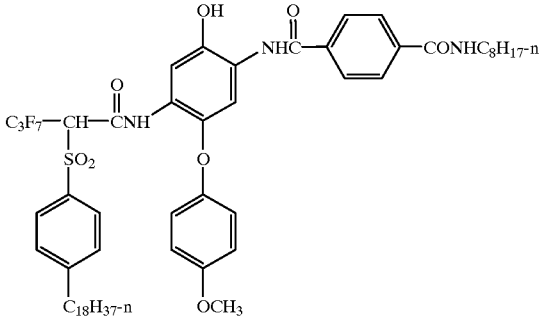
IC-20
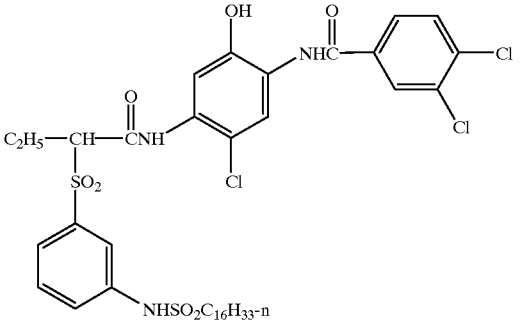
-continued
IC-21
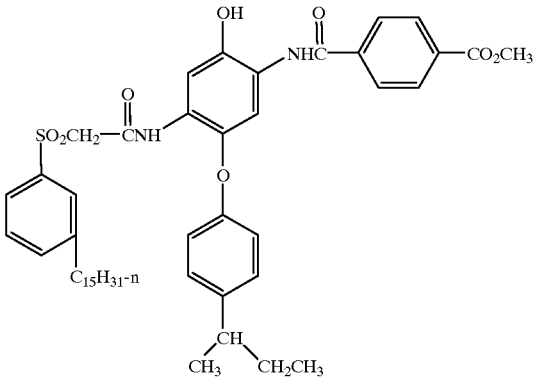
IC-22
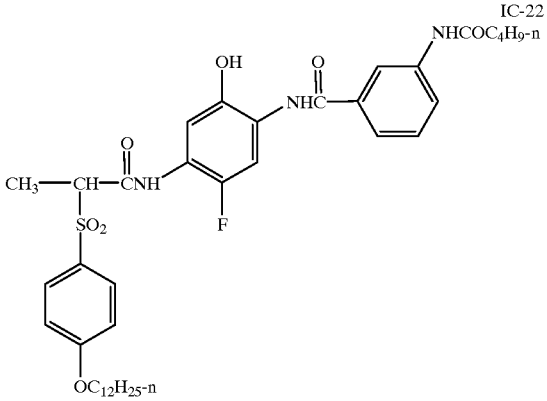
IC-23
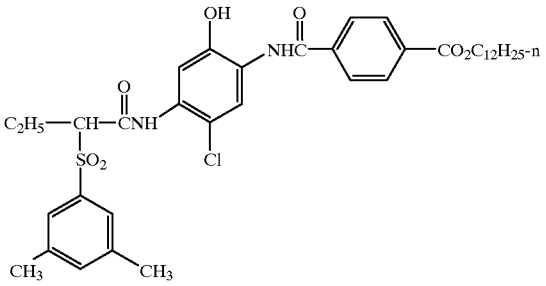
IC-24
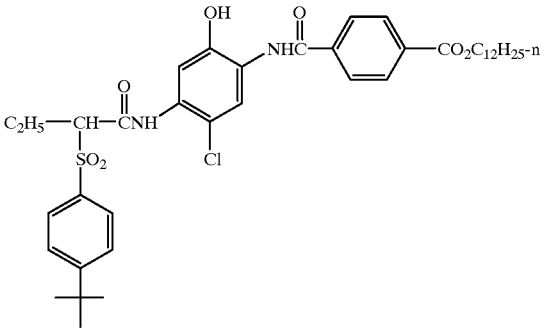

-continued
IC-25
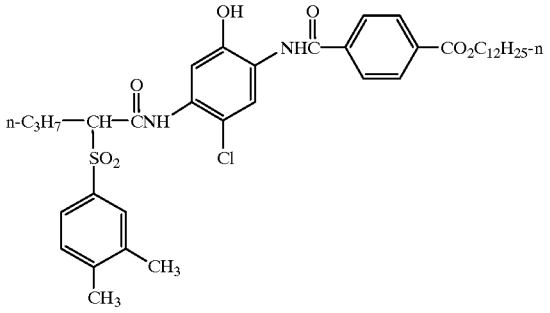
IC-26
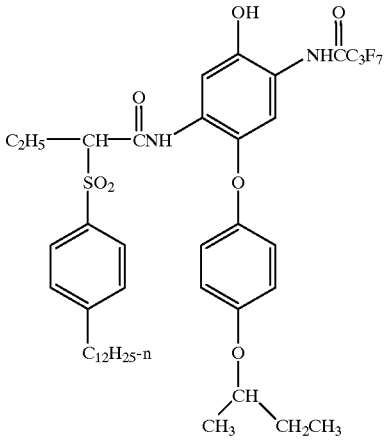
IC-27
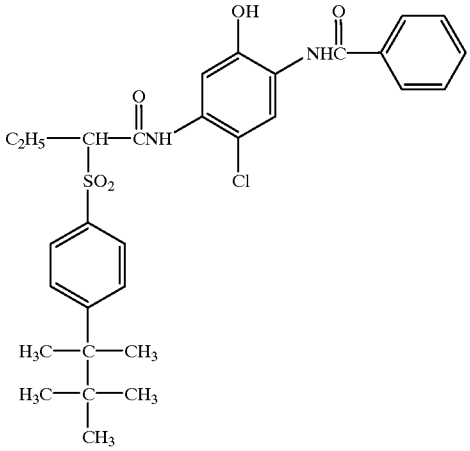
IC-28
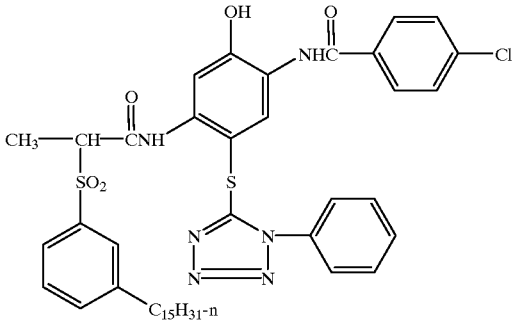
-continued
IC-29
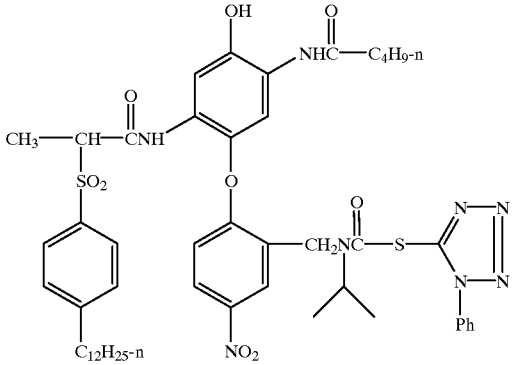
IC-30
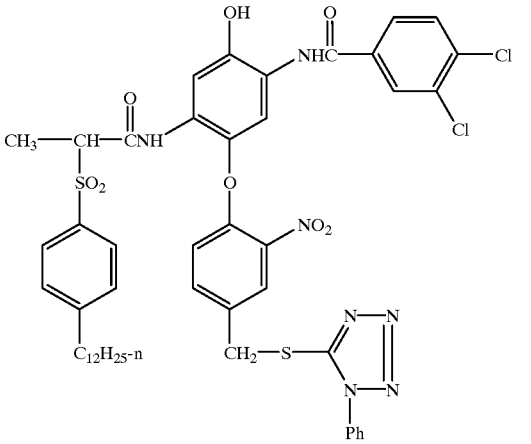
IC-31
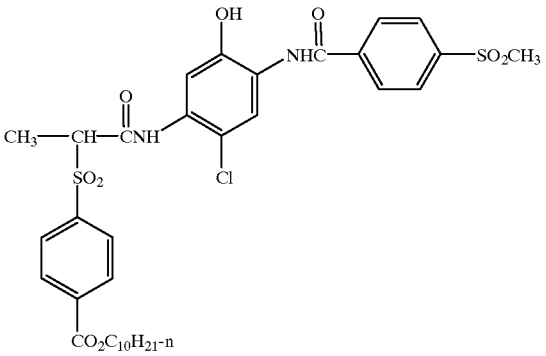
IC-32
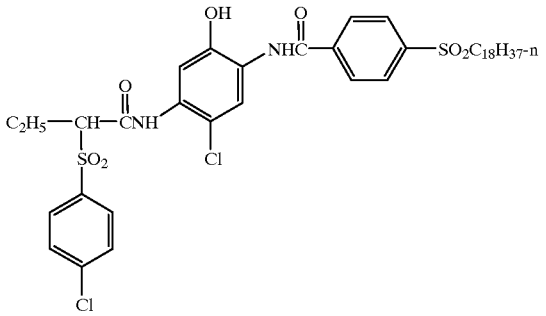

-continued

IC-33

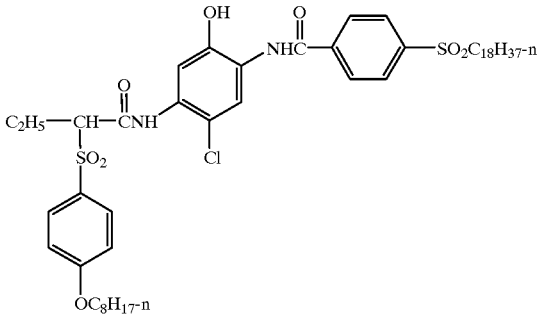

IC-34

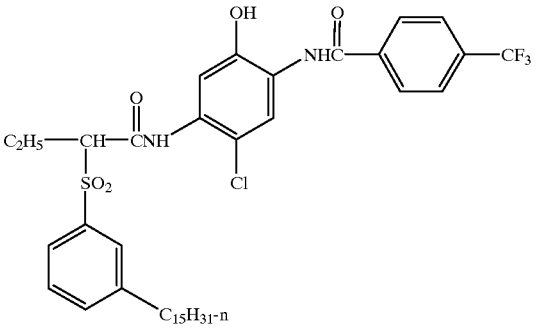

Since the effect of the cyan coupler of the invention is optical rather than chemical, the invention is not limited to a particular compound or class of compounds. Further, more than one coupler of a particular color may be employed in combination which together produce a composite density curve which may satisfy the requirements of the invention.

The dye formed by the magenta coupler of the invention has a density between 0.6 and 1.0 at 520 nm, between 0.9 and 1.0 at 540 nm, and between 0.85 and 1.0 at 560 nm. In a preferred embodiment, the magenta dye has a density between 0.45 and 0.85 at 510 nm, and most preferably a density between 0.30 and 0.80 at 500 nm.

Examples of the magenta couplers of the invention are represented by the following formulas IIA or IIB.

IIA

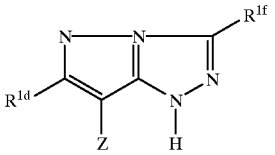

IIB

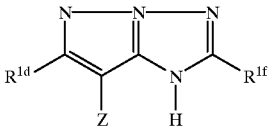

Other examples of suitable magenta couplers are those based on pyrazolones as described hereinafter.

Yellow couplers useful in the invention have a density between 0.90 and 1.0 at 450 nm and between 0.65 and 0.9 at 470 nm, and preferably also have a density between 0.25 and 0.65 at 490 nm. Examples of the yellow couplers suitable for use in the invention are the acylacetanilide couplers, such as those having formula III:

III

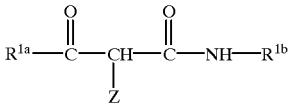

wherein Z represents hydrogen or a coupling-off group bonded to the coupling site in each of the above formulae. In the above formulae, when $R^{1a}$, $R^{1b}$, $R^{1d}$, or $R^{1f}$ contains a ballast or antidiffusing group, it is selected so that the total number of carbon atoms is at least 8 and preferably at least 10.

$R^{1a}$ represents an aliphatic (including alicyclic) hydrocarbon group, and $R^{1b}$ represents an aryl group.

The aliphatic- or alicyclic hydrocarbon group represented by $R^{1a}$ typically has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an a-aminoisopropyl group, an a-(diethylamino)isopropyl group, an a-(succinimido) isopropyl group, an a-(phthalimido)isopropyl group, an a-(benzenesulfonamido)isopropyl group, and the like.

As an aryl group, (especially a phenyl group), $R^{1b}$ may be substituted. The aryl group (e.g., a phenyl group) may be substituted with substituent groups typically having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1b}$ may be substituted with an amino group which may be further substituted with a lower alkyl group having from 1 to 6 carbon atoms, a hydroxyl group, —COOM and —$SO_2$M(M=H, an alkali metal atom, $NH_4$), a nitro group, a cyano group, a thiocyano group, or a halogen atom.

In a preferred embodiment, the phenyl group represented by $R^{1b}$ is a phenyl group having in the position ortho to the anilide nitrogen a halogen such as fluorine, chlorine or an alkoxy group such as methoxy, ethoxy, propoxy, butoxy. Alkoxy groups of less than 8 carbon atoms are preferred.

$R^{1b}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group.

$R^{1d}$ and $R^{1f}$ represent a hydrogen atom, or a substituent group (as defined hereafter in the passage directed to substituents).

Representative examples of magenta and yellow couplers useful in the present invention are as follows:
Magenta Couplers
IM-1
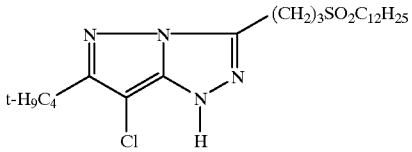
IM-2
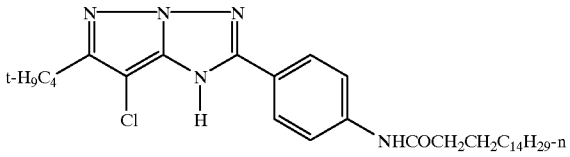
IM-3
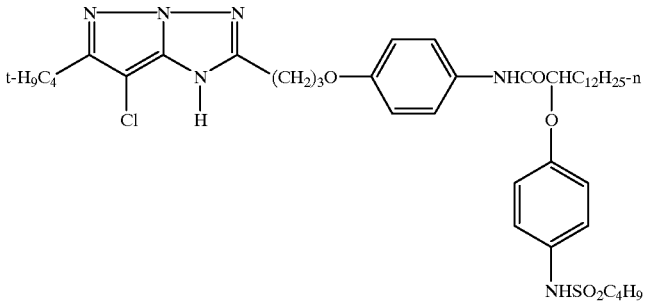
Yellow Couplers
Y-1
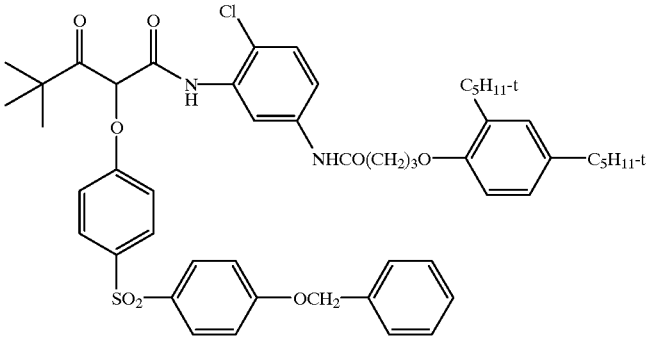
Y-2
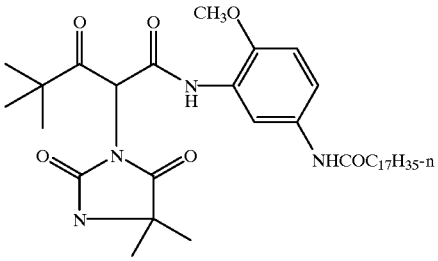

-continued

Y-3

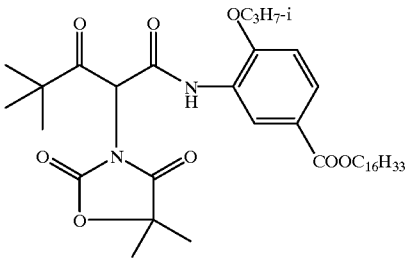

Y-4

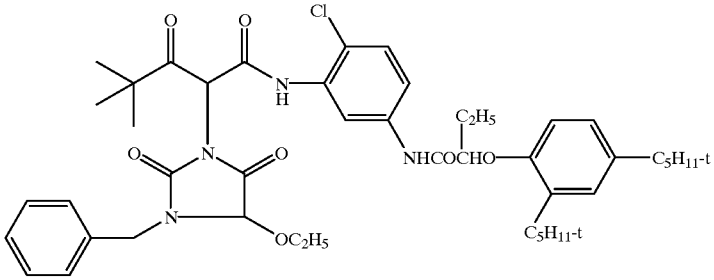

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2- oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Cyan image dye-forming couplers may be included in the element besides the coupler of the invention. These couplers may be located in the same layer as the coupler of the invention or in a different layer.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-anminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

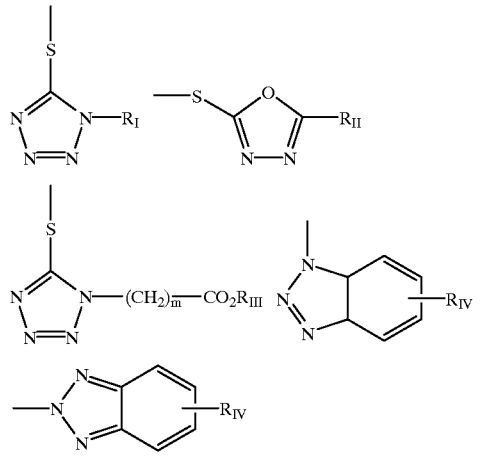

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

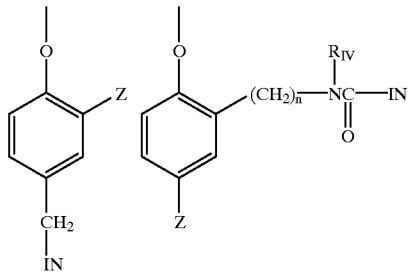

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

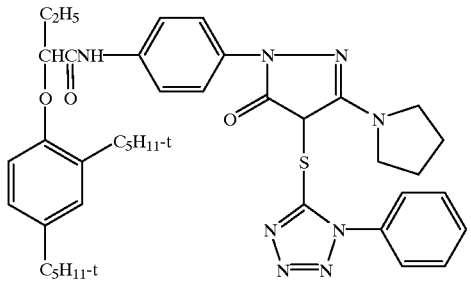

D2

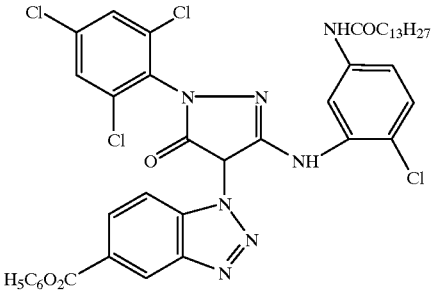

-continued

D3

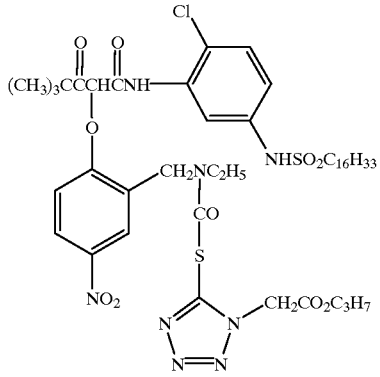

D4

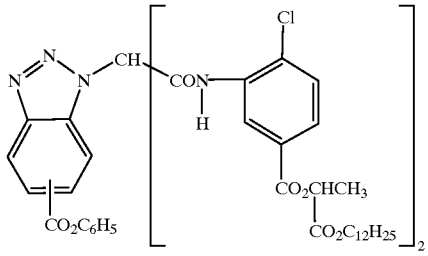

D5

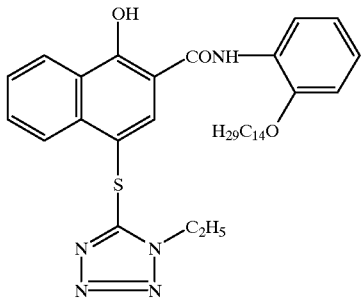

D6

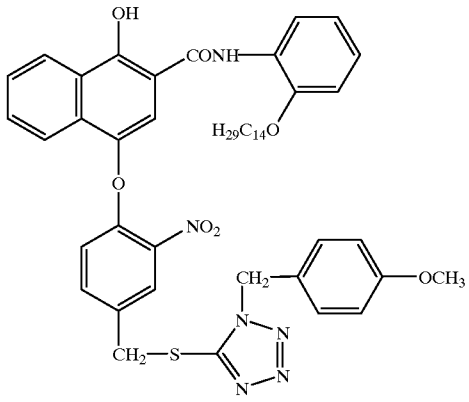

-continued
D7
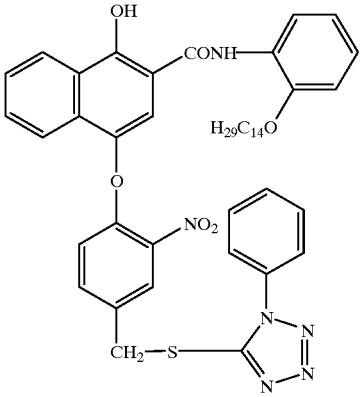
D8
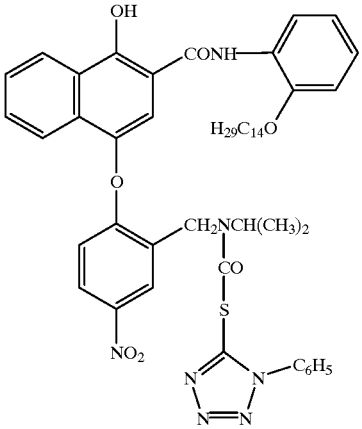
D9
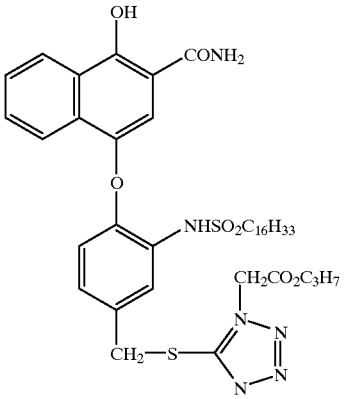
-continued
D10
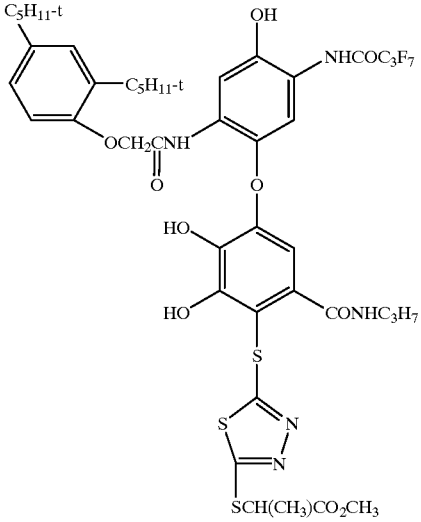
D11
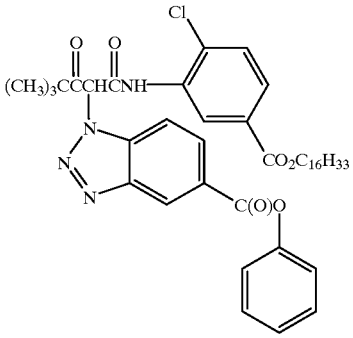
D12
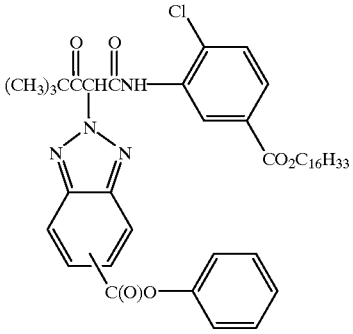

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072, 634; 90-077,822; 90-078,229; 90-078,230; 90-079,336; 90-079,337; 90-079,338; 90-079,690; 90-079,691; 90-080, 487; 90-080,488; 90-080,489; 90-080,490; 90-080,491; 90-080,492; 90-080,494; 90-085,928; 90-086,669; 90-086, 670; 90-087,360; 90-087,361; 90-087,362; 90-087,363; 90-087,364; 90-10 088,097; 90-093,662; 90-093,663; 90-093,664; 90-093,665; 90-093,666; 90-093,668; 90-094, 055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLES

The cyan couplers of this invention can be prepared by reacting alkyl or aryl acid chlorides with an appropriate aminophenol, such as 2-amino-5-nitrophenol or 2-amino4-chloro-5-nitrophenol to form the 2-carbonamido coupler intermediates. The nitro group of the coupler intermediate can then be reduced and a separately prepared sulfone-containing ballast can be attached thereto by conventional procedures. The synthesis of coupler compound IC-3 will further illustrate the invention.

A. Preparation of the Phenolic Coupler Intermediate

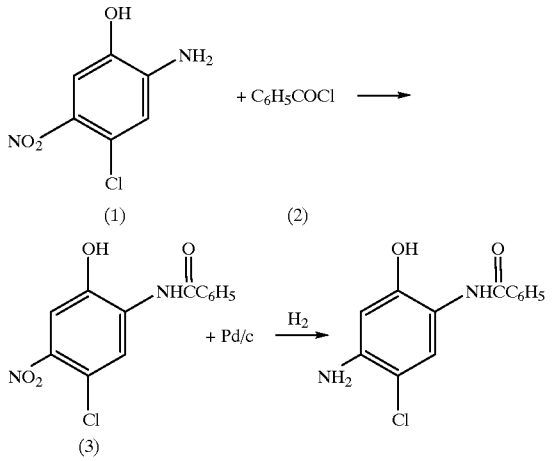

To a stirred solution of 37.7 g (0.20 mol) of 2-amino4chloro-5-nitrophenol (1) and 48.5 g (0.40 mol) of N,N-dimethylaniline in 500 ml THF was added 30.9 g (0.22 mol) of benzoyl chloride (2). After stirring for 3 hours at room temperature, the reaction mixture was drowned in ice water and 20 ml concentrated HCl. The solid which precipitated out was collected, washed with water, and recrystallized from $CH_3CN$ to give 54.6 g of the nitro compound (3).

A solution of 8.8 g (0.03 mol) of (3) in 150 ml THF was heated with a teaspoonful of 10% Pd/C and hydrogenated at room temperature under 50 lb per square inch hydrogen pressure for 3 hours. The catalyst was filtered off to give the reduced aminophenol (4) which was stored under a blanket of nitrogen while the sulfone-containing ballast was being prepared.

B. Preparation of the Ballast Acid Chloride

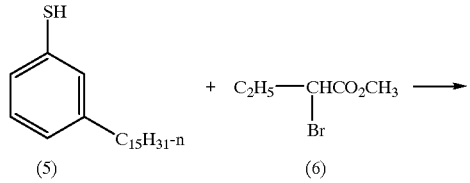

-continued

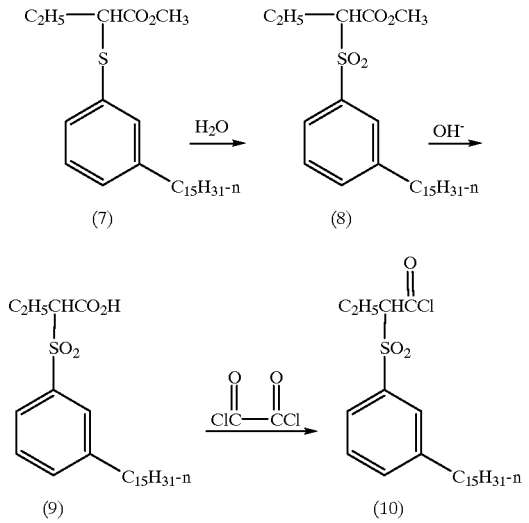

To a well-stirred solution of 40 g (0.13 mol) m-pentadecylphenylthiol (5) and 27 g (0.15 mol) of methyl a-bromobutyrate (6) in 500 ml acetone was added 104 g (0.75 mol) $K_2CO_3$. The mixture was heated on a steam bath and refluxed for 1 hour. After cooling to room temperature the insolubles were filtered off. The filtrate was poured into water and extracted with ethyl acetate. The ethyl acetate was removed under reduced pressure and the residual crude product mixture was dissolved in ligroin. The solution was chromatographed through a short silica gel column, eluting first with ligroin and finally with 50% ligroin-$CH_2Cl_2$ mixture. The fractions containing the pure product were combined and the solvent was removed to give 43 g of (7) as a colorless oil.

The ballast intermediate (7) was taken up in 300 ml acetic acid, cooled to 10–15° C., and treated with 23 ml 30% $H_2O_2$. The mixture was stirred at room temperature for 0.5 hour and then heated on the steam bath for another hour. Upon standing at room temperature overnight the product crystallized out. The pure white solid crystals were collected to give 41.5 g of (8).

The sulfone ballast ester (8) was dissolved in 200 ml $CH_3OH$ and 200 ml THF. The solution was then heated with 18 g NaOH dissolved in 150 ml water. After stirring at room temperature for 1 hour, the mixture was poured into dilute HCl. The white solid that precipitated out was collected, washed with water and dried to give 40 g of the sulfone ballast acid (IX) as a white solid.

To a solution of 13.6 g (0.031 mol) of (9) in 100 ml $CH_2Cl_2$ was added with stirring 11.4 g (0.09 mol) oxalyl chloride and 5 drops of DMF. After stirring at room temperature for 2 hours, the mixture was concentrated to give 13.9 g of ballast acid chloride (10) as an oil.

C. Preparation of Coupler Compound IC-3

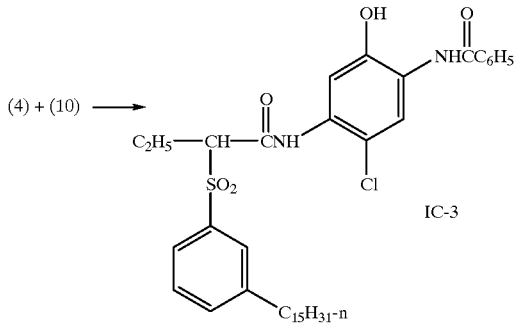

IC-3

To a stirred solution of 7.9 g (0.03 mol) of the aminophenol (4) in 150 ml THF was added 7.3 g (0.06 mol) of N,N-dimethylaniline and 13.9 g (0.03 mol) of the ballast acid chloride (10). After stirring at room temperature for 2 hours the reaction mixture was poured into water containing 5 ml concentrated HCl. The tan colored solid was collected, washed with water, and recrystallized from $CH_3CN$ to give 17.4 g (85%) of crystalline white solid (IC-3). The structure was confirmed by $H^1$ NMR and elemental analysis.

Calcd. for $C_{38}H_{51}C_1N_2O_5S$: C,66.79; H, 7.52; N, 4.10

Found: C, 66.61; H, 7.56; N, 4.02

The couplers of the invention are not limited to those having a particular chemical formula. As indicated earlier, the spectral curve of a given coupler can be affected by the formula, the particle size, other coupler system components etc. These parameters are selected to provide the desired spectral curve.

EXAMPLES

In these examples, the couplers evaluated are as identified in Table I.

TABLE I

| Sample | Color | Description of Coupler(s) |
|---|---|---|
| $CI_1$ | Cyan | 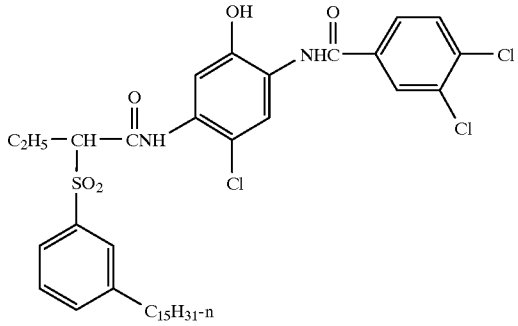 |
| $CC_1$ | " | Ohta optimum |
| $CC_2$ | " | 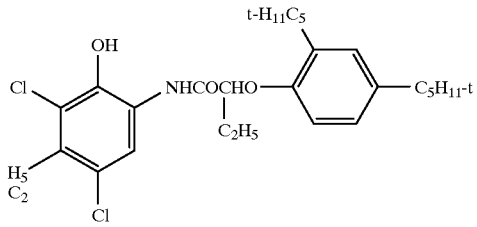 |
| $CC_3$ | " | CC2 + 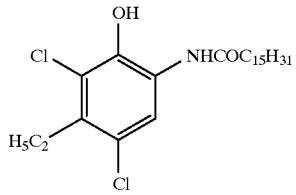 |

TABLE I-continued
| Sample | Color | Description of Coupler(s) |
|---|---|---|
| $CC_4$ | " | $CC_2$ + 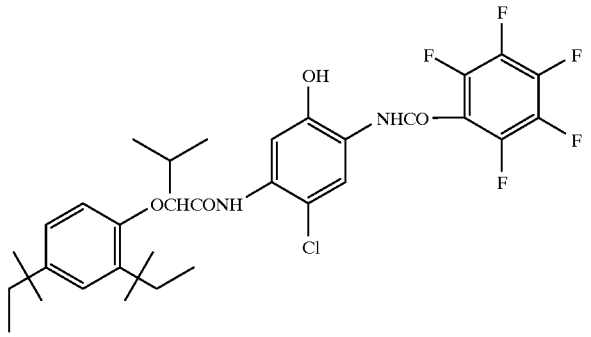 |
| $CC_5$ | " | 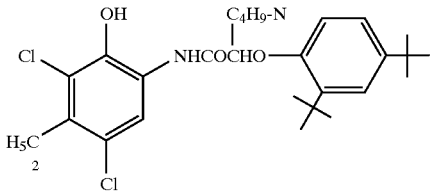 |
| $M_1$ | Magenta | Ohta optimum |
| $M_2$ | " | 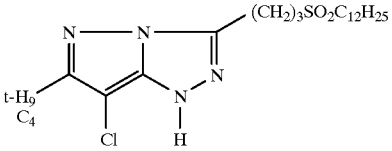 |
| $M_3$ | " | 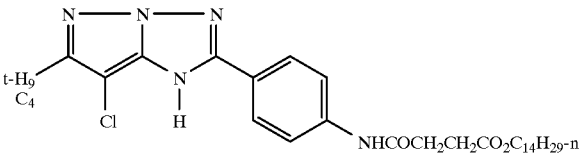 |
| $M_4$ | " | 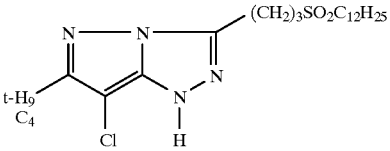 |
| $M_5$ | " | 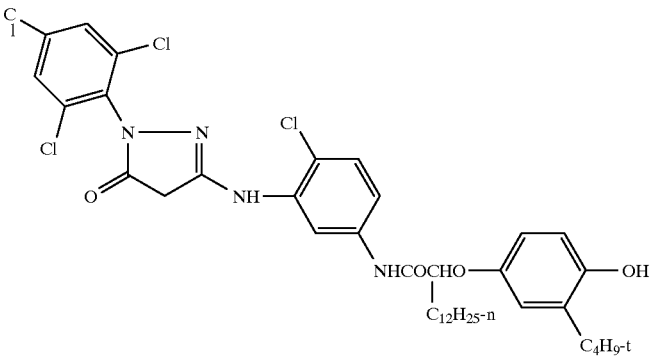 |
| $Y_1$ | Yellow | Ohta optimum |

TABLE I-continued
| Sample | Color | Description of Coupler(s) |
|---|---|---|
| $Y_2$ | " | 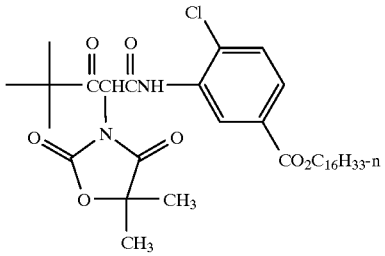 |
| $Y_3$ | " | 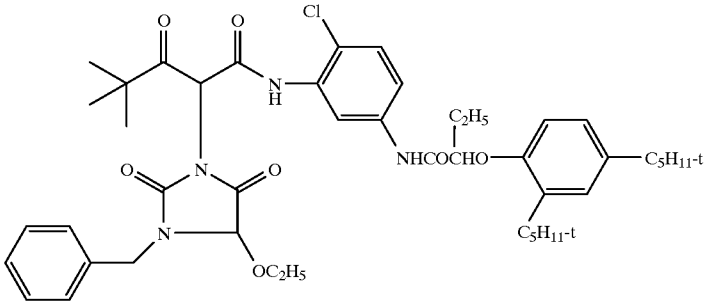 |
| $Y_4$ | " | 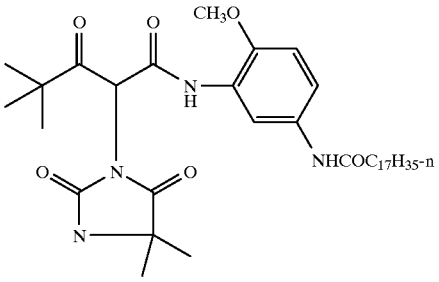 |
| $Y_5$ | " | 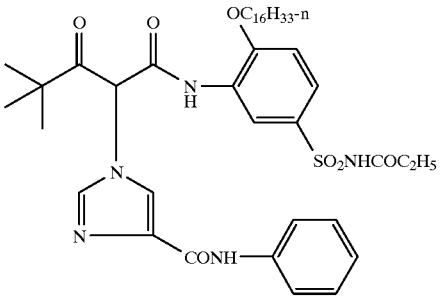 |
+

TABLE I-continued

| Sample | Color | Description of Coupler(s) |
|---|---|---|
| | | 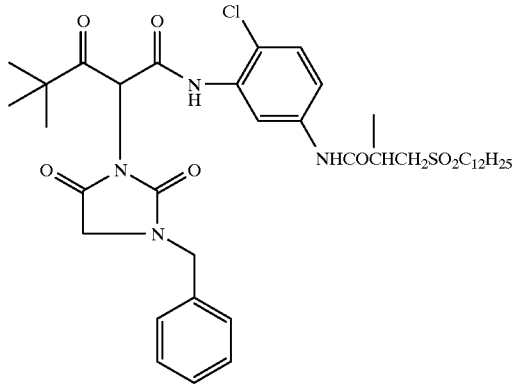 |

For the commercially available comparative samples subscripted 2–5, multilayer samples were obtained. Sequential exposures from red, green, and blue light through an achromatic step tablet were done to produce a range of neutral exposures. Separation exposures were also produced on the same device. A conventional single-layer coating format was used to evaluate the inventive cyan coupler. The single layer sample was also given sequential red, green, and blue light exposures through an achromatic step tablet.

Exposed samples were developed in CD-3 p-phenylenediamine color developer which produced dye densities ranging from Dmin to Dmax.

The spectral absorption curve of each dye was measured using a MacBeth Model 2145 Reflection Spectrophotometer having a Xenon pulsed source and a 10 nm nominal aperture. Reflection measurements were made over the wavelength range of 380–750 manometers using a measurement geometry of 45/0, and the characteristic vector (transmission density -vs- wavelength) for each coupler specimen was calculated. The color gamuts resulting from using the characteristic vectors to calculate the gamut using the methods as described in J. Photographic Science, 38, 163 (1990) were determined and the results are given in Table III. Color gamuts are obtained by the above calculation method, assuming the use of resin-coated photographic paper base material, no light scatter, a D5000 viewing illuminant, and a Dmax of 2.2 status A Density. The optimal spectral regions hold true for any Dmin, any amount of flare, any Dmax and any viewing illuminant.

Using this methodology, the dyes formed by the various couplers tested had spectral curves having densities at the indicated wavelengths as shown in the following tables.

TABLE IIA

| | | Cyan Density Values At Indicated Wavelength | | | |
|---|---|---|---|---|---|
| | | D580 | D590 | D600 | D610 |
| | | Preferred Range | | Inventive Range | |
| Cyan Coupler | Type | 0.3–1.0 | 0.5–1.0 | 0.7–0.78 | 0.8–0.91 |
| $CI_1$ | Inv | 0.38 | 0.53 | 0.72 | 0.89 |
| $CC_1$ | Comp | 0.42 | 0.51 | 0.62 | 0.74 |
| $CC_2$ | Comp | 0.42 | 0.52 | 0.63 | 0.73 |
| $CC_3$ | Comp | 0.40 | 0.49 | 0.60 | 0.71 |

TABLE IIA-continued

| | | Cyan Density Values At Indicated Wavelength | | | |
|---|---|---|---|---|---|
| | | D580 | D590 | D600 | D610 |
| | | Preferred Range | | Inventive Range | |
| Cyan Coupler | Type | 0.3–1.0 | 0.5–1.0 | 0.7–0.78 | 0.8–0.91 |
| $CC_4$ | Comp | 0.45 | 0.56 | 0.67 | 0.77 |
| $CC_5$ | Comp | 0.40 | 0.49 | 0.60 | 0.71 |

Table IIA shows that only the cyan coupler $CI_1$ falls within the inventive density range for both 600 and 610 nm. The inventive cyan also falls within the ranges at 580 and 590 nm as well. None of the comparison cyan couplers is within the prescribed range at both 610 and 600 nm.

TABLE IIB

| | Magenta Density Values At Indicated Wavelength | | | | |
|---|---|---|---|---|---|
| Magenta | D500 | D510 | D520 | D540 | D560 |
| | Desired Ranges | | | | |
| Coupler | 0.30–0.80 | 0.45–0.85 | 0.60–1.0 | 0.9–1.0 | 0.85–1.00 |
| $M_1$ | 0.59 | 0.74 | 0.88 | 1.0 | 0.85 |
| $M_2$ | 0.49 | 0.66 | 0.81 | 0.99 | 0.90 |
| $M_3$ | 0.50 | 0.65 | 0.78 | 1.0 | 0.88 |
| $M_4$ | 0.46 | 0.62 | 0.77 | 0.97 | 0.92 |
| $M_5$ | 0.62 | 0.77 | 0.89 | 1.0 | 0.79 |

Table IIB shows that magenta coupler $M_5$ is the only coupler that does not form a dye within the desired range.

TABLE IIC

| | Yellow Density Values At Indicated Wavelength | | |
|---|---|---|---|
| | Density at 450 nm | Density at 470 nm | Density at 490 nm |
| | | Desired Ranges | |
| Yellow Coupler | 0.9–1.0 | 0.65–.90 (0.65–0.76 preferred) | 0.25–0.65 (0.25–0.42 preferred) |
| $Y_1$ | 1.0 | 0.78 | 0.59 |
| $Y_2$ | 1.0 | 0.83 | 0.51 |

TABLE IIC-continued

| | Yellow Density Values At Indicated Wavelength | | |
|---|---|---|---|
| | Density at 450 nm | Density at 470 nm | Density at 490 nm |
| | Desired Ranges | | |
| Yellow Coupler | 0.9–1.0 | 0.65–.90 (0.65–0.76 preferred) | 0.25–0.65 (0.25–0.42 preferred) |
| $Y_3$ | 1.0 | 0.79 | 0.45 |
| $Y_4$ | 0.98 | 0.75 | 0.40 |
| $Y_5$ | 0.99 | 0.83 | 0.52 |

Table IIC shows that yellow coupler $Y_4$ forms a dye having densities within the desired range.

TABLE III

| Color Gamut Values | | | | | |
|---|---|---|---|---|---|
| Sample | Type | Colorant Set | Gamut - Color Space Volume | Improve-ment | Improve-ment % |
| 1 | Comp | $CC_2/M_2/Y_2$ | 53,501 | — | |
| 2 | Comp | $CC_1/M_2/Y_2$ | 52,334 | −1,167 | −2.2 |
| 3 | Inv | $CI_1/M_2/Y_2$ | 55,773 | +3,439 | +6.4 |
| 4 | Comp | $CC_3/M_3/Y_3$ | 57,558 | — | |
| 5 | Comp | $CC_1/M_3/Y_3$ | 56,966 | −592 | −1.0 |
| 6 | Inv | $CI_1/M_3/Y_3$ | 60,426 | +2,868 | +5.0 |
| 7 | Comp | $CC_4/M_4/Y_4$ | 55,498 | — | |
| 8 | Comp | $CC_1/M_4/Y_4$ | 55,107 | −391 | −0.7 |
| 9 | Inv | $CI_1/M_4/Y_4$ | 58,179 | +2,681 | +4.8 |
| 10 | Comp | $CC_5/M_5/Y_5$ | 50,200 | — | |
| 11 | Comp | $CC_1/M_5/Y_5$ | 49,042 | −1,158 | −2.3 |
| 12 | Inv | $CI_1/M_5/Y_5$ | 52,315 | +2,115 | +4.2 |
| 13 | Inv | $CI_1/M_3/Y_3$ | 60,426 | — | |
| 14 | Inv | $CI_1/M_3/Y_4$ | 61,238 | +812 | +1.3 |

In Table III, the color gamut values were obtained using various sets of magenta, cyan and yellow couplers. For each group of three samples, the first sample represents a magenta, yellow, and magenta coupler set used in a commercial product. Color gamut volumes were then determined for the dyes formed from the coupler set using color developer CD-3 (4-amino-3-methyl-N-ethyl-N-(2-methanesulfonamido-ethyl)aniline sesquisulfate hydrate). The second coupler set in each group represents the result when the optimum cyan dye of Ohta is substituted for the commercial cyan. This substitution does not improve the gamut in any of the comparisons. The third coupler set in each group represents the result of substituting the cyan coupler of the invention for the commercial cyan coupler but without changing the magenta and yellow couplers. An improvement in gamut of from 4 to 6% is realized over the commercial combination for each set. The last two samples serve to demonstrate the advantage of the preferred yellow coupler of the invention.

The entire contents of the various patent applications, patents and other publications referred to in this specification are incorporated herein by reference.

What is claimed is:

1. A photographic element comprising a first light sensitive silver halide emulsion layer having associated therewith a cyan dye-forming coupler, a second light sensitive silver halide emulsion layer having associated therewith a magenta dye-forming coupler, and a third light sensitive silver halide emulsion layer having associated therewith a yellow dye-forming coupler, wherein the normalized spectral transmission density distribution curve of the dye formed by the cyan coupler upon development with a p-phenylenediamine developer has a density between 0.7 and 0.78 at 600 nm and a density between 0.8 and 0.91 at 610 nm.

2. The element of claim 1 wherein the distribution curve of the cyan coupler also has a density between 0.5 and 1.0 at 590 nm.

3. The element of claim 2 wherein the distribution curve of the cyan coupler also has a density between 0.3 and 1.0 at 580 nm.

4. The element of claim 1 wherein the distribution curve of the magenta coupler has a density between 0.6 and 1.0 at 520 nm, between 0.9 and 1.0 at 540 nm, and between 0.85 and 1.0 at 560 nm.

5. The element of claim 4 wherein the distribution curve of the magenta coupler also has a density between 0.45 and 0.85 at 510 nm.

6. The element of claim 5 wherein the distribution curve of the magenta coupler also has a density between 0.3 and 0.8 at 500 nm.

7. The element of claim 4 wherein the distribution curve of the yellow coupler has a density between 0.90 and 1.0 at 450 nm and between 0.65 and 0.9 at 470 nm.

8. The element of claim 7 wherein the distribution curve of the yellow coupler has a density between 0.25 and 0.65 at 490 nm.

9. The element of claim 8 wherein the density at 490 nm is between 0.25 and 0.42.

10. The element of claim 9 wherein the density at 470 nm is between 0.65 and 0.76.

11. The element of claim 1 wherein the distribution curve of the dye formed by the yellow coupler has a density between 0.90 and 1.0 at 450 nm and between 0.65 and 0.9 at 470 nm.

12. The element of claim 11 wherein the distribution curve of the dye formed by the yellow coupler has a density between 0.25 and 0.65 at 490 nm.

13. The element of claim 12 wherein the density of the dye formed by the yellow coupler at 490 nm is between 0.25 and 0.42.

14. The element of claim 13 wherein the density of the dye formed by the yellow coupler at 470 nm is between 0.65 and 0.76.

15. The element of claim 1 wherein the p-phenylenediamine developer used to form the cyan dye is selected from the group consisting of 4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

16. The element of claim 1 wherein the p-phenylenediamine developer used to form the cyan dye is selected from the group consisting of 4-amino-3-methyl-N-ethyl-N-(2-methanesulfonamido-ethyl)aniline sesquisulfate hydrate, and 4-amino-3-methyl-N-ethyl-N-(2-hydroxyethyl)aniline sulfate.

17. A method of forming an image in the element of claim 1 after the element has been image-wise exposed to light, comprising contacting the element with a p-phenylenediamine color developing agent.

18. The method of claim 17 wherein the developer is selected from the group consisting of 4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

19. The method of claim 18 wherein the developer is 4-amino-3-methyl-N-ethyl-N-(2-methanesulfonamido-ethyl)aniline sesquisulfate hydrate.

* * * * *